United States Patent [19]

Altman

[11] 4,163,277

[45] Jul. 31, 1979

[54] SPOTLIGHT

[76] Inventor: Charles W. Altman, 5 Rudolph Ter., Yonkers, N.Y. 10701

[21] Appl. No.: 824,060

[22] Filed: Aug. 12, 1977

[51] Int. Cl.[2] ..... F21V 7/00

[52] U.S. Cl. ..... 362/263; 362/296; 362/347; 362/350

[58] Field of Search ..... 362/263, 296, 347, 350

[56] References Cited

U.S. PATENT DOCUMENTS 3,940,606 2/1976 Lemons ..... 362/263

*Primary Examiner*—Stephen J. Lechert, Jr.

*Attorney, Agent, or Firm*—Wolder, Gross & Yavner

[57] ABSTRACT

An axial spotlight system, including an axially mounted arc lamp in an ellipsoidal reflector. The usually associated thermal problem at the forward terminal of the lamp is eliminated by a metal mounting frame which connects the terminal to the reflector and thereby performs as a heat sink for the lamp to avoid deterioration of the forward terminal. To further limit problems at the forward terminal of the lamp a lead wire is permanently affixed thereto and accurate focusing of the lamp is accomplished by means of the metal mounting frame holding the front of the lamp and an adjustment assembly holding the back of the lamp.

5 Claims, 6 Drawing Figures

SPOTLIGHT

This invention relates to light projectors and more specifically to theatrical spotlights for projecting an adjustable high intensity beam of light.

A spotlight may be defined as a means for projecting a brilliant source of light over a considerable distance to a relatively small area as an object. During the past few years, a number of improvements have taken place with respect to the design of spotlight sources and the reflectors used therewith.

For instance, U.S. Pat. No. 3,940,606 detailed the problems associated with reflector design and accomplished a relatively optimum spotlight arrangement by placing the source of light at an oblique angle with respect to the principal axis of the reflector, thereby maximizing the output of a high intensity spotlight with an altered reflector design. According to the patentee for that design, such an arrangement overcame problems previously associated with the light loss experienced by designs wherein source electrodes actually were placed in a plane in front of the leading edge of the reflector; and further represented an improvement in terms of axial sources wherein the front terminal was subject to deterioration because it intersected the light emitted by the source.

Of course, the axial arrangements mentioned by Lemons in U.S. Pat. No. 3,940,606 would, but for the deterioration problem, represent a significant advance in the state of the art with respect to optimum reflector design and maximized light emission.

The present invention comprises an axial source without problems of deterioration that have been experienced by the prior art in such systems.

Accordingly, a primary object of the present invention is to provide a spotlight where the source is mounted such that the terminals of the source are coincident with the optical axis of the reflector.

A further object of the present invention is to provide a spotlight wherein a greater portion of the emitted light is gathered by the reflector without deterioration of the front terminal of the light source.

These, and other objects of the present invention are accomplished in a spotlight design which features a substantially ellipsoidal reflector having a first focal point at which is placed an envelope enclosed arc source having forward and back terminals. The terminals are arranged coincident with the optical axis of the reflector with the front terminal being supported by a metal mounting frame having generally horizontally arranged legs connecting the forward terminal with the reflector. The metal mounting frame legs are relatively flat and arranged edgewise when considered from a view forward of the leading edge of the reflector. The rear terminal includes an adjustable mount having a back support arm firmly attached to the forward edge of the reflector, an insulator arranged generally perpendicular to the back support arm and mounted thereon by means of an adjustable mount for moving the insulator forward and rearward, as well as laterally and the insulator is attached to the rear terminal of the source by a mounting clip. Focusing of the arc in the reflector is provided by motion of the insulator caused by its mount and insulation required for high voltage lamp ignition is also provided by the insulator. A permanent contact for the front terminal of the lamp is accomplished by a high temperature solder to permanently affix a lead wire to the front terminal. Another lead wire is affixed to the rear terminal to enable ignition.

Other features and advantages of the present invention will become apparent by means of the following more detailed description of a preferred, but nontheless illustrative, embodiment of the present invention, with reference to the accompanying drawings, wherein.

Figure 1:
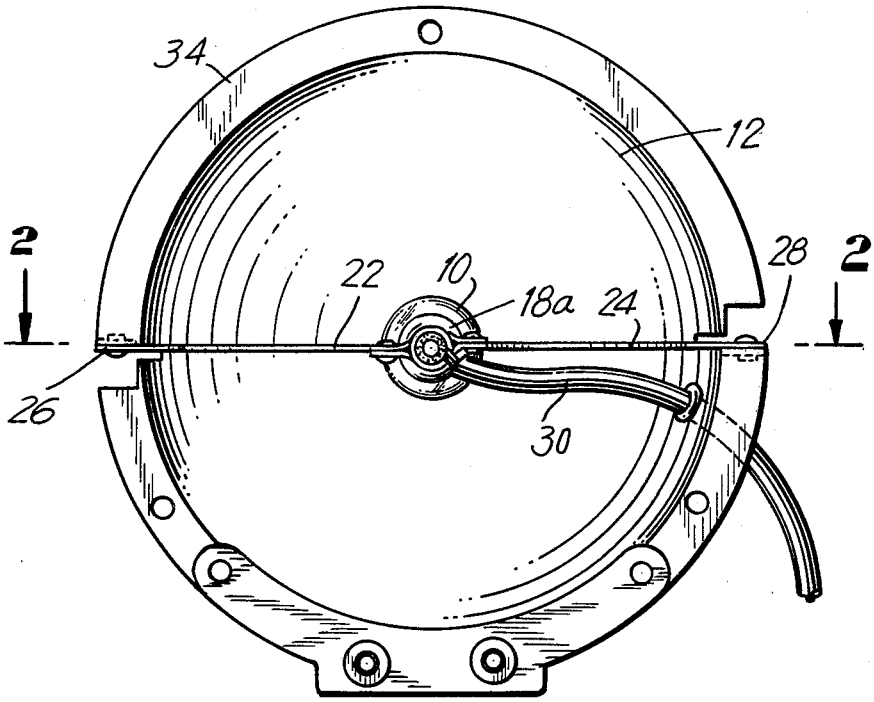
FIG. 1 is a front view of a spotlight including reflector and source according to the present invention, and showing particularly the metal mounting frame and permanent front terminal lead wire connection thereto.
Figure 2:
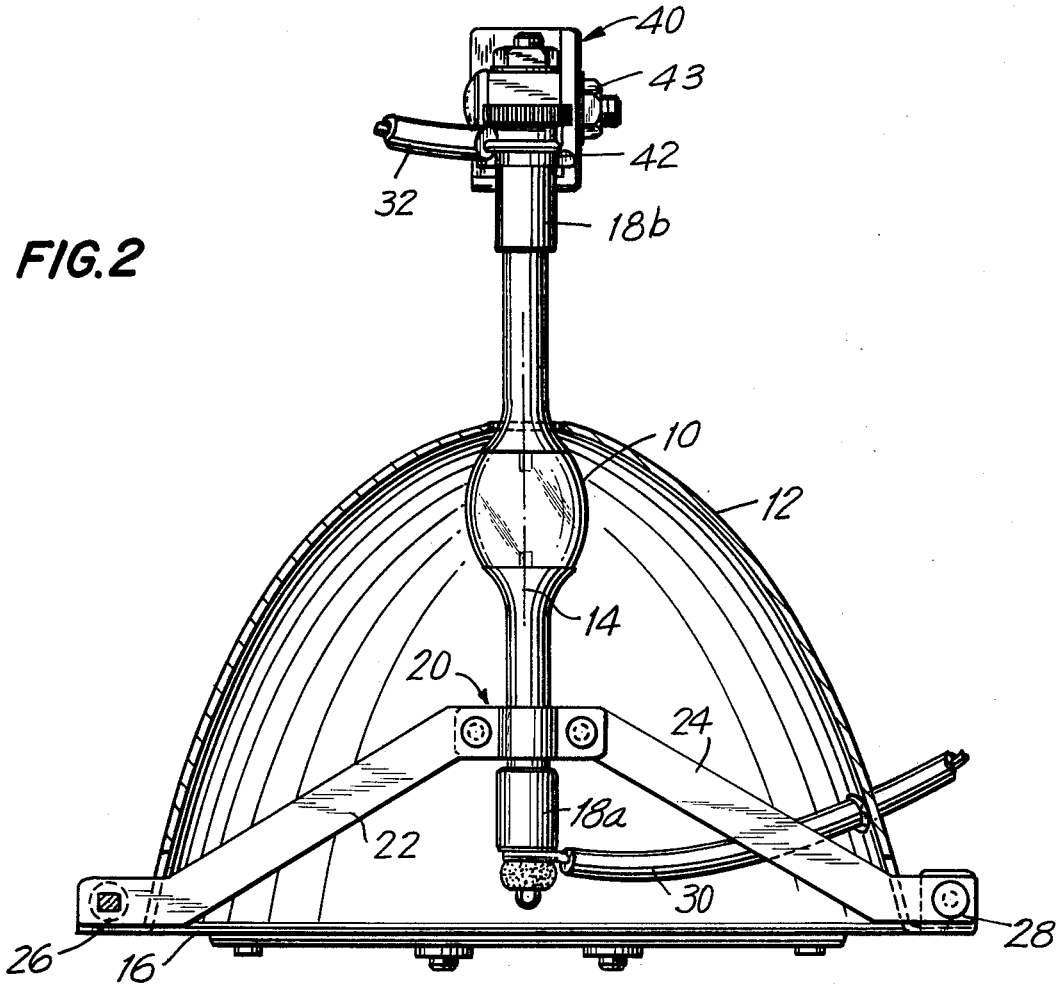
FIG. 2 is a sectional view of FIG. 1, taken along the line 2—2 thereof, illustrating the placement of the lamp source in the reflector, its support by a metal mounting frame at the forward terminal thereof and the adjustable back support.

Referring to the drawings, FIGS. 1-4 show a spotlight comprising a source of light 10 positioned at the first focal point of an ellipsoidal reflector 12. The reflector 12 has a major optical axis 14 (FIGS. 2 and 3) which passes through the first focal point and the center of the leading edge 16 of the reflector 12.

The light source 10 has a longitudal axis defined by two spaced terminals **18*a*, 18*b* and that longitudal axis coincides with the major optical axis of reflector 12**.

In the prior art, as exemplified by U.S. Pat. No. 3,940,606, the coincidence of the longitudal axis defined by the source terminals and the major optical axis of the reflector was considered unsatisfactory because of the deterioration brought upon the terminal **18*a* nearest the leading edge 16 of reflector 12**. That forward terminal deteriorated mainly because of the concentration of energy by the reflector at that point when the light source was arranged axially in the reflector. Such a situation was improved by a design shown in U.S. Pat. No. 3,940,606 wherein the light source was arranged at an oblique angle with respect to the main axis of the reflector. However, such obliquely arranged sources suffered numerous disadvantages in terms of efficiency with respect to output of the unit, even though such efficiency was an overall improvement over the previously axially arranged light source configurations.

In the present invention, all disadvantages are substantially overcome by use of metal mounting frame 20 which includes legs 22, 24 affixed near the forward terminal **18*a* of light source 10. Such legs 22, 24 are attached to the reflector at points 26, 28 in order to function as a heat sink for concentrated energy visited upon the forward terminal 18*a* by light source 10**.

It may be seen particularly from FIG. 1, that the arrangement of legs 22, 24 is such that they present an edgewise exposure when viewed from the light source 10 so that blockage of reflected light is at a minimum. Furthermore, according to the present invention, the attachment of wire 30 to forward terminal **18*a* is accomplished in a permanent manner by means of a high temperature solder. Still further, a second lead wire 32 is attached at the rear terminal 18***b* to complete an electrical circuit for igniting light source 10. It should be mentioned at this point that light source 10 may be a 575 watt HMI lamp rather than the 1200 watt HMI lamps used typically in the configuration of U.S. Pat. No. 3,940,606.

Figure 3:
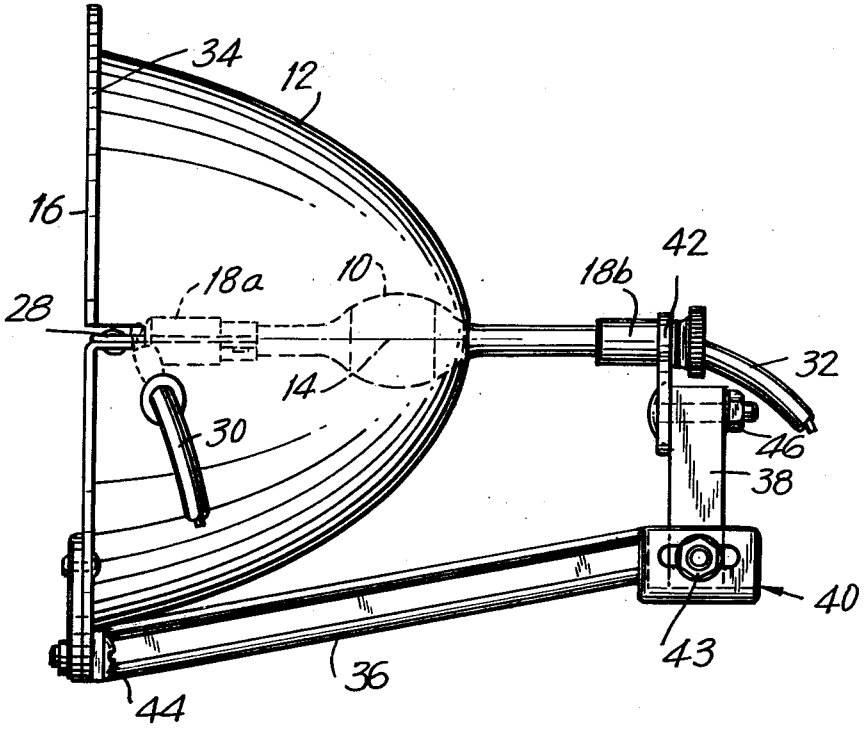
FIG. 3 is a side view representation showing the adjustable rear terminal mount in more detail and particularly the forward and rearward adjustment means.

The reflector 12 is appropriately mounted by means of a reflector frame 34 (FIG. 4) which functions to attach metal mounting frame 20 at points 26, 28. Furthermore, such frame enables attachment of back support arm 36, which in turn mounts insulator 38 by means of adjustable mount generally designated 40 (FIG. 3). Insulator 38 is attached to the rear terminal 18*b* of the source by mounting clip 42.

Figure 4:
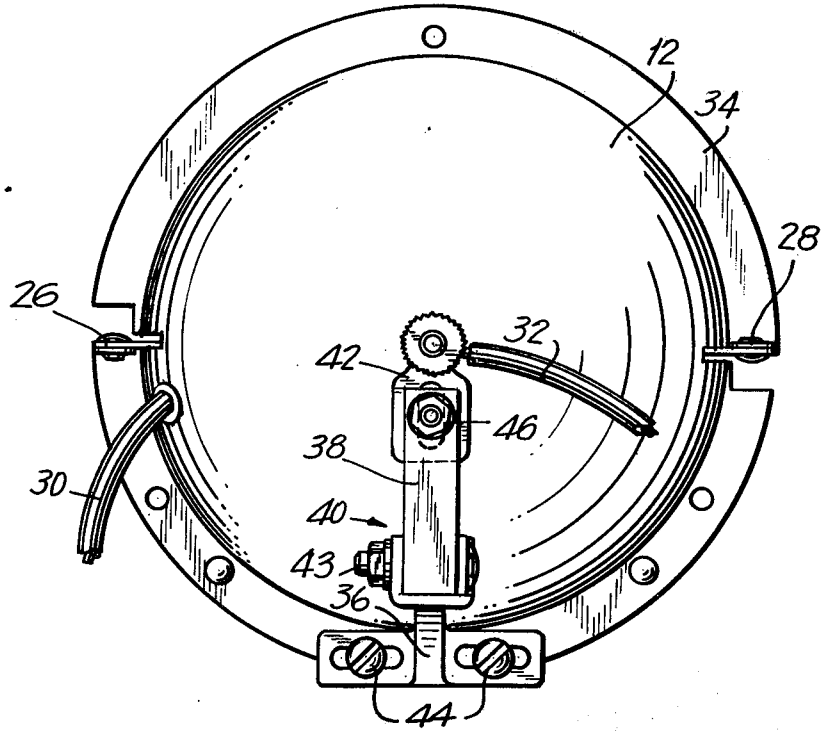
FIG. 4 is a back view of the present invention showing particularly the laterally adjustable mount for the rear terminal of the source.

More specifically, adjustable mount 40 is shown clearly in FIGS. 3 and 4 as including a forward and rearward adjustment lug 43 and lateral adjustment lugs 44. Also, mounting clip 42 is held to insulator 38 by means of adjustment lug 46 for upward and downward motion of rear terminal 18*b*.

Thus, it may be seen from FIGS. 1 through 4 that an efficient, high output spotlight source is provided with its lamp source arranged in a configuration (axially) to avoid the danger of forward terminal deterioration. Still further, the adjustment capability by means of a mount for rear terminal 18*b* is such that fine tuning of the spotlight is readily achieved.

Figure 6:
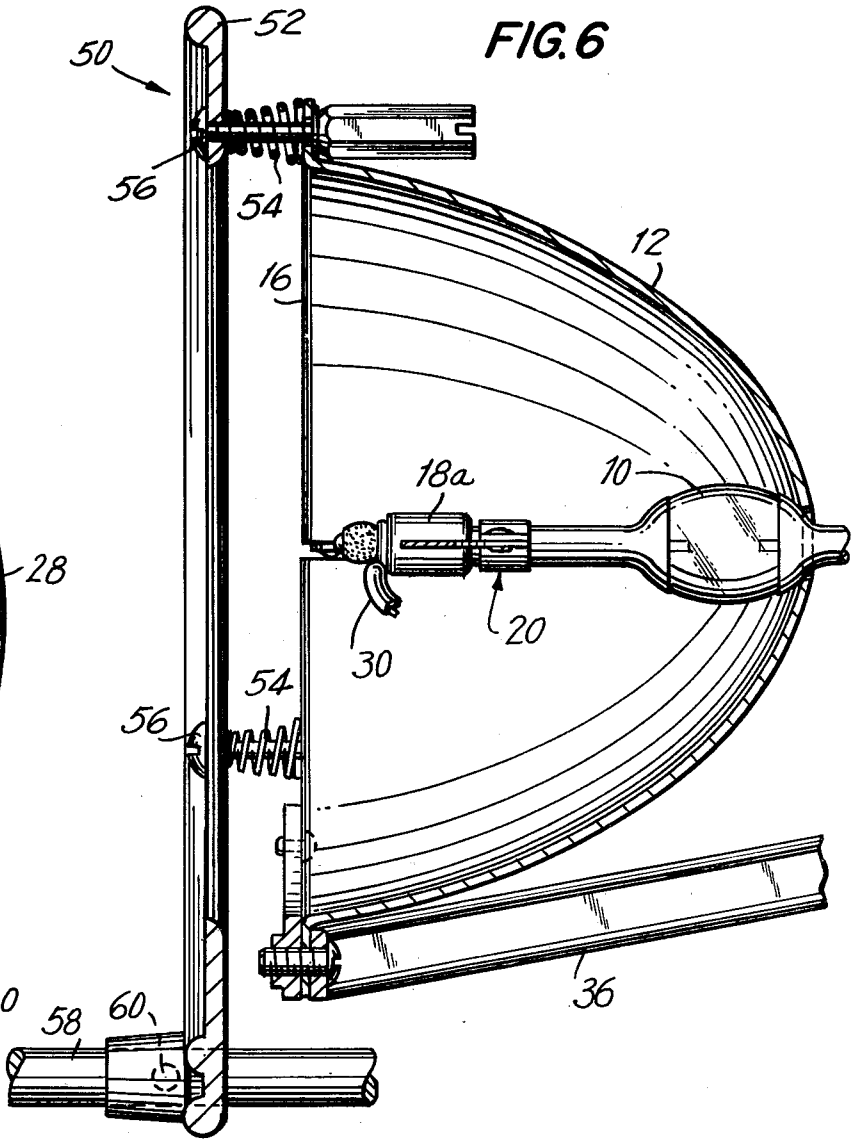
FIG. 6 is a sectional view of FIG. 5 taken along the line 6—6 thereof.
Figure 5:
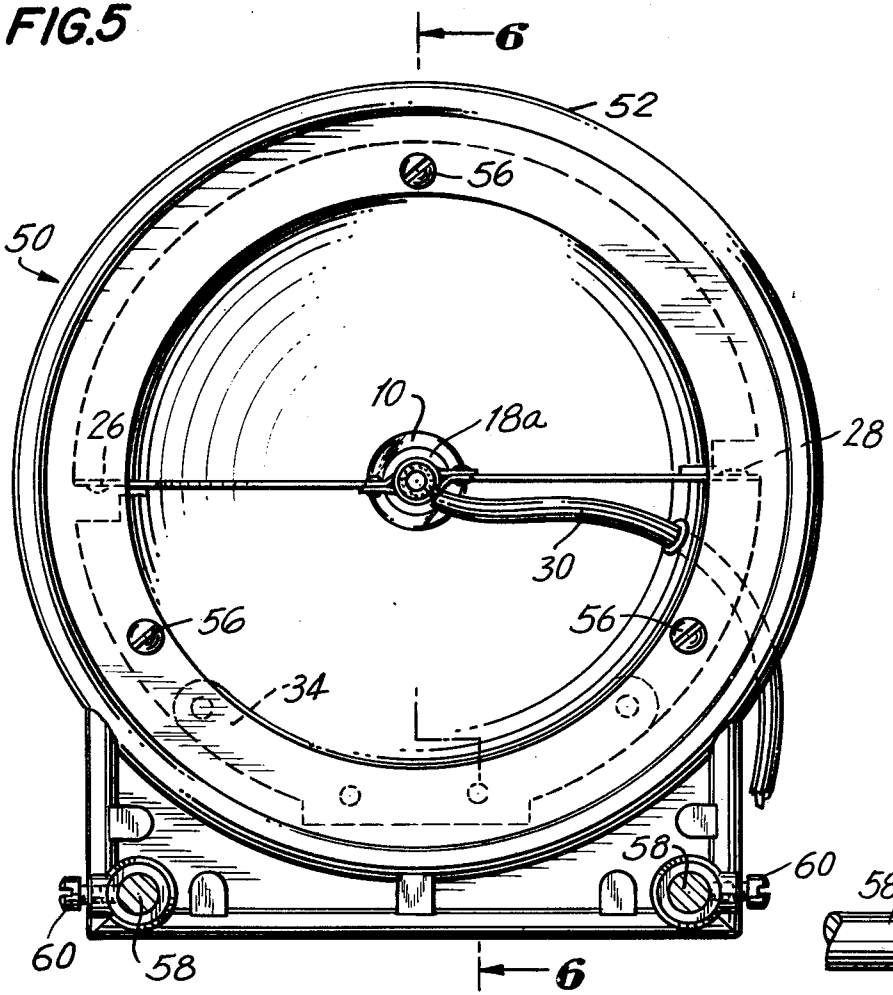
FIG. 5 is a front view of a spotlight according to the present invention showing particularly an adjustable outside relector mount.

FIGS. 5 and 6 illustrate the configuration of the present invention with outside mount 50 in place near the leading edge 16 of reflector 12. Specifically, outside mounting frame 52 is attached by means of springs 54 at spaced intervals separated from leading edge 16 of reflector 12. Thus, a further dimension of adjustment is enabled by bolts 56. Also, tracks 58 enable even further adjustment as controlled by set screws 60.

Accordingly, an efficient, high intensity spotlight is provided in a novel axial configuration for the source without attendant deterioration of the forward terminal of the source.

What is claimed is:

1. An axial spotlight for use with a metal halide high intensity discharge lamp having forward and rear terminals and a longitudinal axis therebetween, the invention comprising an ellipsoidal reflector having a main axis, a metal mounting frame thermally connecting said forward terminal to said reflector and means for mounting said lamp with its longitudinal axis coincident with the main axis of said reflector.

2. The invention according to claim 1 wherein said means for mounting includes a back support arm attached to said reflector, an insulator adjustably mounted on said arm by a first mount and a mounting clip connecting said insulator to said rear terminal as a second mount.

3. The invention according to claim 1 wherein said metal mounting frame includes a pair of opposed legs each connected between a point rearwardly of said forward terminal and said reflector.

4. The invention according to claim 2 wherein said first mount moves said rear terminal laterally, forwardly and rearwardly of said main axis and said second mount moves said rear terminal upwardly or downwardly of said main axis.

5. The invention according to claim 1 wherein said spotlight further includes an adjustable outside reflector mount.

* * * * *